US005972462A

United States Patent [19]

Sutherland et al.

[11] Patent Number: 5,972,462

[45] Date of Patent: Oct. 26, 1999

[54] MATTING

[76] Inventors: Thomas Langley Sutherland, Knockishee House, Glenluce, Newton Stewart, Dumfries & Galloway, DG8 OLJ, Scotland; George MacDonald Sutherland, Ellenbank, 59 West Main Street, Uphall, West Lothian, Scotland, both of United Kingdom

[21] Appl. No.: 08/952,614

[22] PCT Filed: May 20, 1996

[86] PCT No.: PCT/GB96/01206

§ 371 Date: Nov. 19, 1997

§ 102(e) Date: Nov. 19, 1997

[87] PCT Pub. No.: WO96/36268

PCT Pub. Date: Nov. 21, 1996

[30] Foreign Application Priority Data

May 19, 1995 [GB] United Kingdom ..... 9510211

[51] Int. Cl.[6] ..... B32B 3/02; A47L 23/26

[52] U.S. Cl. ..... 428/88; 428/85; 428/95; 428/167; 15/215

[58] Field of Search ..... 428/85, 88, 95, 428/167; 15/215

[56] References Cited

U.S. PATENT DOCUMENTS

| | | | |
|---|---|---|---|
| 2,436,315 | 2/1948 | Liberatore . | |
| 2,701,890 | 2/1955 | Moor, Jr. . | |
| 4,109,439 | 8/1978 | Feasel . | |
| 4,408,365 | 10/1983 | Palmer | 428/167 |
| 4,796,399 | 1/1989 | Kessler et al. . | |
| 5,529,825 | 6/1996 | Sutherland | 428/88 |
| 5,660,906 | 8/1997 | Hill | 428/88 |

FOREIGN PATENT DOCUMENTS

| | | |
|---|---|---|
| 0202846 | of 0000 | European Pat. Off. . |
| 0507415 | of 0000 | European Pat. Off. . |
| 669319 | of 0000 | France . |
| 191838 | of 0000 | United Kingdom . |

*Primary Examiner*—Terrel Morris

*Attorney, Agent, or Firm*—Howard & Howard

[57] ABSTRACT

An entrance matting comprises an upper layer and a lower layer. The upper layer includes a plurality of spaced upstanding strips having slots therebetween. An upper surface of each strip defines transversely extending channels in communication with the slots. Strips of carpet are located in the slots such that the strips collectively define a substantially continuous tread surface. The lower layer defines a plurality of spaced slots intersecting the slots in the upper layer to permit water to drain therethrough.

9 Claims, 4 Drawing Sheets

MATTING

This invention relates to improved matting and in particular, but not exclusively, to entrance matting suitable for use in applications where water is likely to be deposited on the matting.

Entrance or threshold matting is often provided at the entrances of stores, offices and public buildings, to minimize the amount of dirt and water that is carried into the buildings on the feet of people entering the buildings. WO-A-9307789 describes entrance matting including a flexible rubber base layer and a flexible rubber upper layer comprising spaced upstanding strips. Strips of carpet are fixed in the lots between the rubber strips. the matting is located at a building entrance with the strips perpendicular to the direction of traffic over the matting. The rubber strips have ribbed upper surfaces and serve as scrapers to remove larger particles of dirt. The carpet strips are useful for removing finer particles of dirt and will also retain moisture. However, in particularly, wet conditions the carpet strips may become saturated, rendering the matting less effective. Other forms of entrance matting are described in GB-A-2256584, GB-A-2010087, GB-A-2153668, FR-A-852638, U.S. Pat. No. 4,587,148, and U.S. Pat. No. 4,408,365.

There have been proposals for matting intended to deal with relatively wet conditions, such as U.S. Pat. No. 2,436,315. This document describes a door mat having a flexible mat body with an upper surface defined by spaced scraper ribs, water draining grooves along the sides of the ribs, and troughs for receiving brushes between the ribs. The water draining grooves are provided with drain apertures at various points along their length, leading into bottom drain grooves in the underside of the mat for draining water away from the bottom of the door mat. The brushes are removable and are held in place by rods engaging through apertures in the flexible mat body and transversely through apertures in the brushes. While this form of mat may be acceptable for use as a small area door mat on which people wipe their feet, it is now considered desirable to provide relatively large areas of entrance matting at the entrances to public buildings; many people do not attempt to clean their feet on entering a building, and a small area mat is relatively ineffective in these circumstances. Current practice is to provide a relatively large area mat, for example as described in WO-A-9307789, which all operate "passively" if necessary as people walk over the mat. This necessitates that the mat has an attractive or unobtrusive appearance and is pleasant to walk upon. Thus, a mat such as described in U.S. Pat. No. 2,436,315 would prove unsuitable as the extensive and highly visible water draining grooves would detract from the appearance of a large area mat and would likely prove uncomfortable to walk upon, with the lateral water draining grooves increasing the likelihood of tripping. Such grooves would also result in vibration or resonance when run over with a shopping trolley or child's push chair or stroller, which certain persons may find unpleasant and, in the latter case, may result in a sleeping child being wakened. Dirt and other debris would also likely gather in the grooves and would tend to block the drain apertures. In addition, a large area mat made in accordance with U.S. Pat. No. 2,436,315 would likely be prohibitively expensive, and the uneven surface of the mat would provide difficult to clean effectively using conventional vacuum cleaners.

U.S. Pat. No. 4,796,399 describes a mat comprising an integrally molded portion comprising three types of ribs and a plurality of separately formed carpet strips. The carpet strips are placed between adjacent upper ribs and are held therein by friction, adhesive or mechanical means, such as clips. Bottom support ribs extend perpendicularly to the upper ribs and support he upper ribs and carpet strips clear of the support substrate. Tertiary ribs extend parallel to the bottom support ribs and have bottom surfaces co-extensive with the bottom surface of the upper ribs, the upper surface of the tertiary ribs serving as supporting surfaces. The spaced apart upper ribs provide a drain for run off water, with the carpet strips being placed in every second, third and fourth space, the carpet serving to wipe moisture from shoes walking over the carpet strips.

It is among the objects of embodiments of the present invention to provide entrance matting suitable for use in wet conditions which is pleasant and safe to walk upon and which provides an attractive appearance.

According to the present invention there is provided matting comprising an upper layer and a lower layer, the upper layer including a plurality of spaced upstanding strips having slots therebetween and an upper surface of each strip defining transversely extending channels in communication with the slots, and strips of carpet being located in the lots such that the strips collectively define a tread surface, the lower layer defining a plurality of spaced slots intersecting the slots in the upper layer to permit water to drain therethrough.

In use, the upper tread surface is safe and pleasant to walk upon and easily cleaned. Any water falling onto the upstanding strips quickly flows through the channels into the upper slots and then into the lower slots, with water falling onto the carpet strips flowing into the upper slots and then into the lower slots. As a result, water flows quickly from the tread surface and will not gather or collect thereon, such that the mat retains its cleaning function, even in the wettest conditions, and retains a "dry" appearance. The only drainage feature visible in normal use will be the channels in the upstanding strips, and these will be short and need not be particularly deep or wide; the channels may even be arranged in an attractive pattern, or in the form of letters to spell out store names and the like. Further, the use of carpet strips permits matching with, for example, the color scheme of a store interior, such that the mat is relatively unobtrusive or even attractive and does not detract from a customer's initial impression on first entering the store.

The invention thus provides an unobtrusive but effective means of draining water from the matting. The absence of any large drainage apertures or deep grooves or the like on the upper surface of the mat also tends to hold dirt on or close to the surface of the mat, from where it may be removed by cleaning with, for example, conventional vacuum cleaners. This minimizes the volume of dirt which travels beneath the matting and thus reduces the frequency of occasions on which the mat must be lifted for cleaning the floor beneath.

Any reference to carpet strips is intended to encompass strips of materials commonly used in flooring, including conventional carpeting and core or other fibrous materials.

Preferably, the upper surfaces of the upstanding strips are convex, such that water will tend to flow from the surfaces of the strips towards the slots.

Preferably also, the slots in the upper and lower layers are substantially perpendicular to one another.

The carpet strips may comprise pile and a backing. The backing may be water permeable, however, testing has indicated that, surprisingly, an impermeable backing is preferable as this minimizes the passage of dirt through the carpet and into the drainage slots, thus minimizing the frequency of cleaning the underside of the matting. Passage of water between the carpet backing and the walls of the upper slots may be ensured by providing strips of carpet which are slightly narrower than the slots. The resulting gaps are not visible without close inspection and are soon completely hidden with the flattening and spreading of the carpet pile through use. Alternatively, the upper slots may be widened at the intersections with the lower slots.

Preferably, the channels in the upper surface of the upstanding strips intersect the slots in the upper layer adjacent intersections between the upper and lower slots; water draining from the surface of an upstanding strip is thus led directly to a lower slot. Most preferably, the channels define a criss-cross pattern such that each channel extends between the slots on either side of a strip and intersects at least one other channel, with this arrangement it is unlikely that a slot will ever become completely blocked such that water become trapped therein.

The carpet strips may be secured in the slots by any suitable means, including pressure sensitive adhesive or double-sided tape. If desired, the carpet strips may be removable to, for example, permit replacement of worn strips.

Preferably also, the layers are of a flexible and resilient yet hard-wearing material, such as natural rubber or soft PVC. thus, in use, the flexible matting may be laid over relatively large areas of uneven or undulating floor, such as a screeded concrete base, without requiring leveling, and will not "rock" once fitted.

The upper and lower layers may be formed by any suitable process, for example by molding, by extruding the layers individually and then bonding them together, or by extruding both layers together.

This and other aspects of the present invention will now be described, by way of example, with reference to the accompanying drawings, in which.

Figure 1:
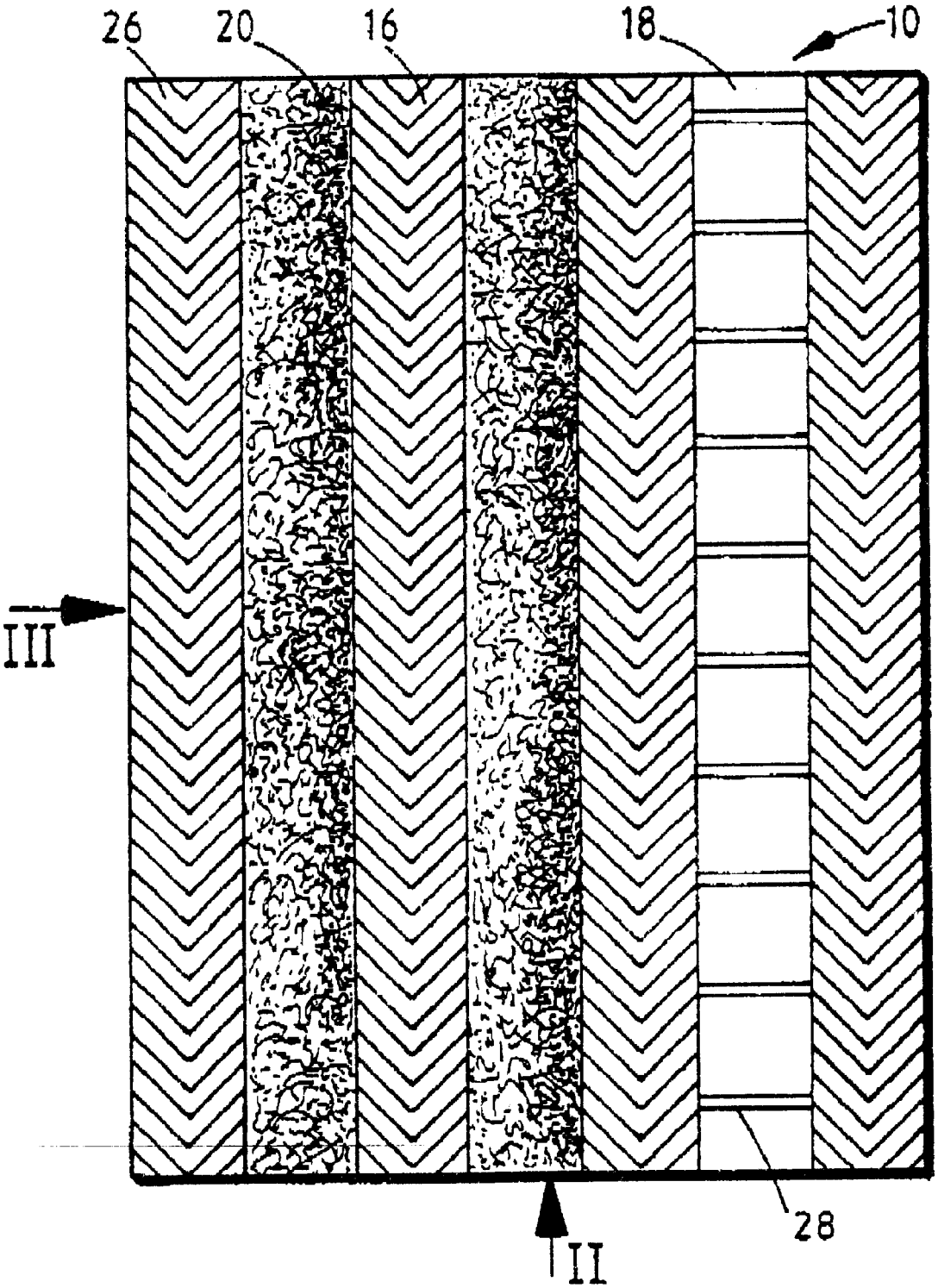
FIG. 1 is a plan view of matting in accordance with a preferred embodiment of the present invention.
Figure 2:
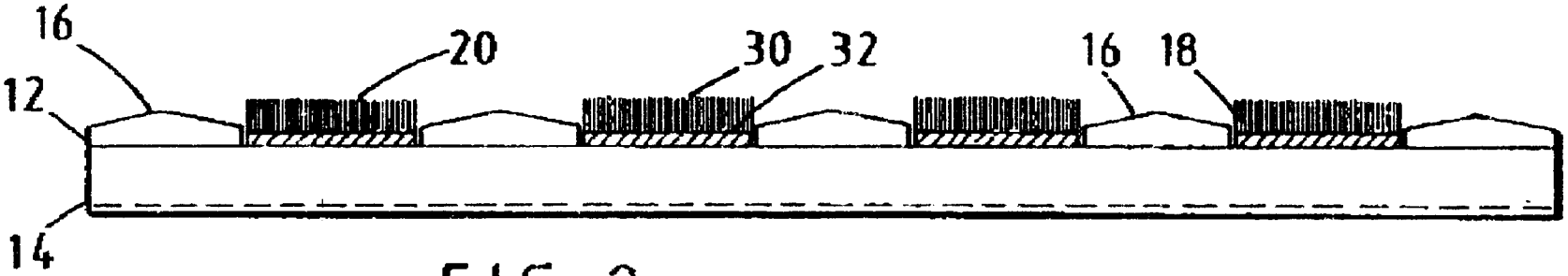
FIG. 2 is a side view of the matting of FIG. 1, looking in direction II.
Figure 3:
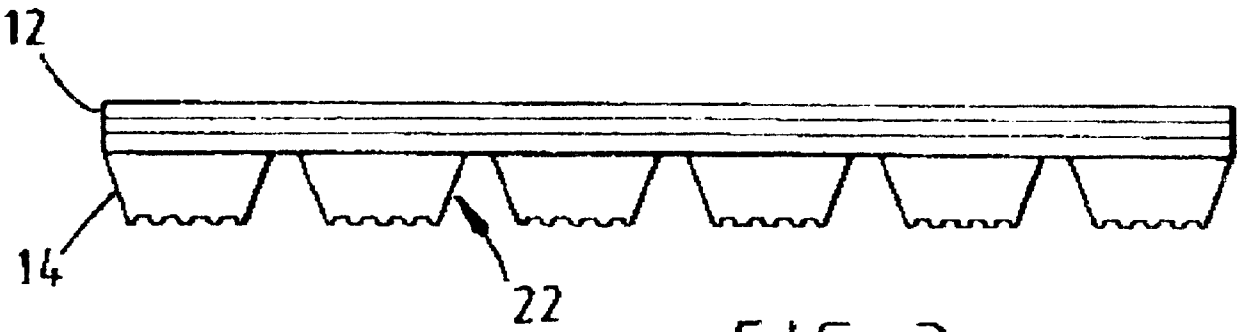
FIG. 3 is an end view of the matting of FIG. 1, looking in direction III.

FIGS. 1, 2 and 3 of the drawings illustrate entrance matting 10 in accordance with a preferred embodiment of the present invention. The matting 10 comprises an upper layer 12 and a lower layer 14, the upper layer 12 defining a plurality of spaced upstanding strips 16 having slots 18 therebetween. Strips of carpet 20 are located in the slots such that the strips 16, 18 collectively define a tread surface. The lower layer 14 defines a plurality of spaced slots 22 which intersect the slots 18 in the upper layer 12 to permit water to drain from the carpet 20 through the matting 10.

As may be seen from FIG. 2, the upper surface of the strips 16 is slightly convex, such that water will tend to flow from the surfaces of the strips into the lots 18. The strips 16 also include chevron-shaped channels 24 which assist in directing water into the slots 18, and also provide a non-slip surface which is more effective in removing dirt from feet.

The slots 18 are of generally similar width to the strips 16 and are generally rectangular. However, the drain slots 22 are of trapezoidal strips 26 therebetween.

In FIG. 1, one of the carpet strips 20 has been removed to reveal the openings 28 that are formed where the slots 18, 22 intersect. The carpet strips 20, which are formed of pile 30 (40/60 nylon/polypropylene) fixed in an impermeable PVC backing 3, are slightly narrower than the slots 18 to provide space for water to pass between the carpet 20 and the walls of the lot 18 and through the openings 28. It has been found that quite a small gap is sufficient to permit water to drain from the carpet 20 and thus prevent the carpet from becoming saturated, even in the wettest conditions. The provision of a relatively small gap also minimizes the amount of dirt that passes through the carpet pile 30 and under the matting 10, the build-up of which would otherwise require the matting 10 to be lifted frequently for cleaning. When the carpet strips are fitted in the slots 18, using double sided tape or some other suitable adhesive, the gaps between the sides of the carpet 20 and the walls of the slots 18 are only visible on close inspection. However, after a small amount of use, the pile 30 tends to spread and flatten thus concealing the gaps completely.

The upper and lower layers 12, 14 are formed of a flexible and resilient yet hard wearing material, such as natural rubber or soft PVC. Thus, the matting 10 may be readily cut to suit a particular application, and will also conform to irregular surfaces. The upper and lower layers 12, 14 may be formed by molding or extrusion, with the carpet strips 20 then being fixed in the slots 18.

In use, the matting 10 will be placed in a shallow tray at a the entrance to, for example, a public building. The tray should be provided with some form of drain. The matting 10 is cut to fit neatly within the tray and with the strips 16, 20 perpendicular to the direction of traffic. As people walk over the matting 10, loose dirt, dust and snow will be dislodged by the strips 16, 20. Any water carried on to the surface of the matting 10 flows from the surface of the strip 16 into the channels 24, or through the carpet pile 30, to the drainage openings 28 and into the drain slots 22, and then flows towards the tray drain. As the matting 10 is flexible, it is possible to provide the tray with a camber, to facilitate drainage.

Figure 4:
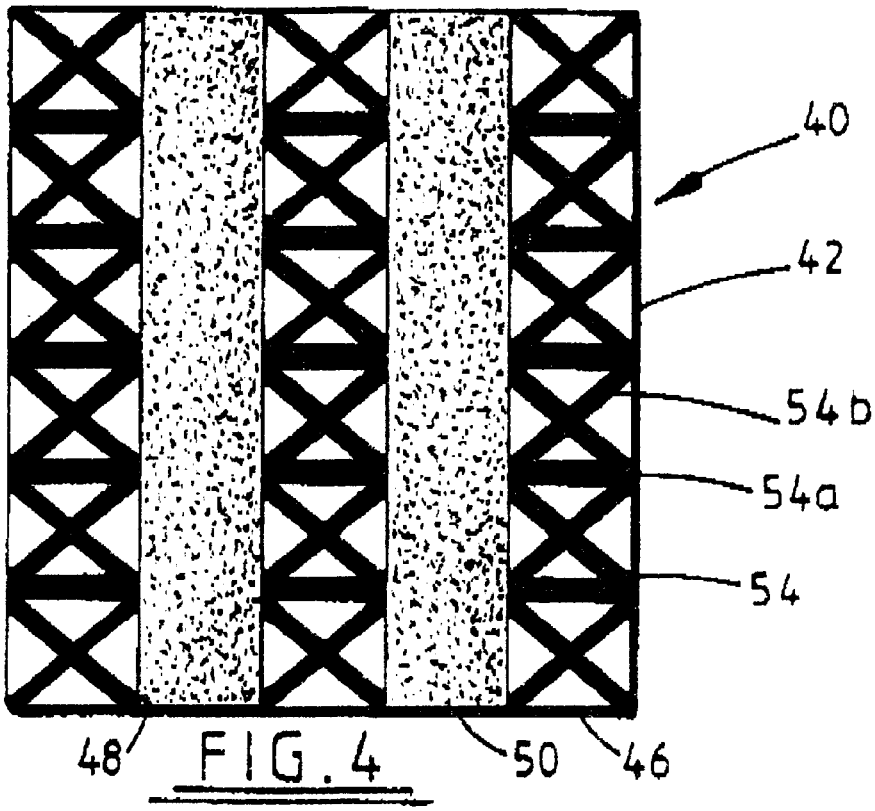
FIG. 4 is a plan view of matting in accordance with a second embodiment of the present invention.
Figure 6:
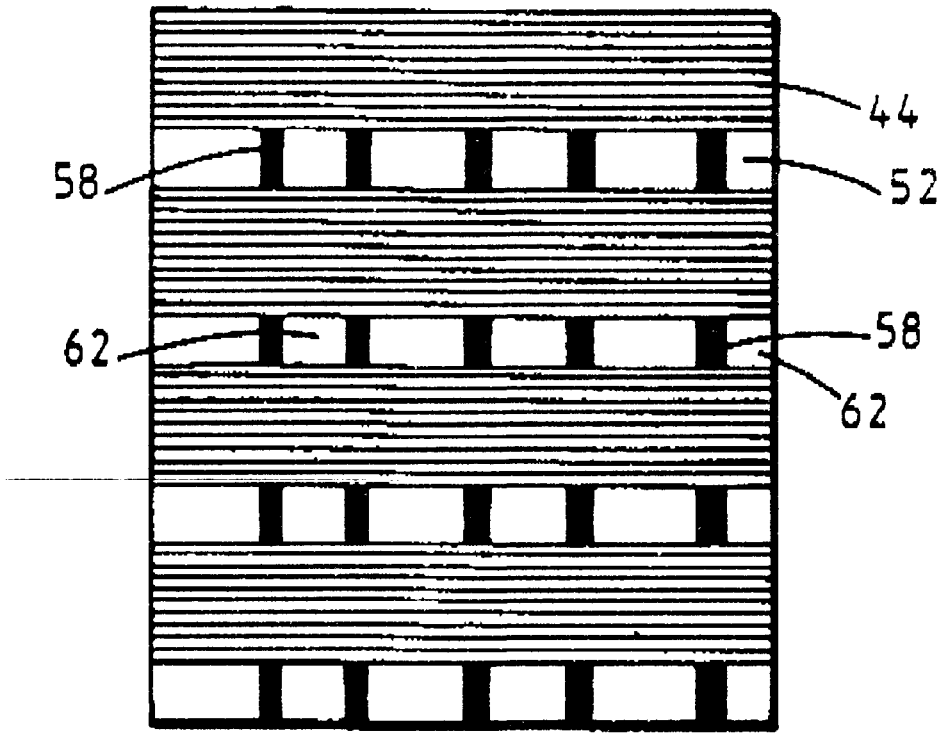
FIG. 6 is a view from below of the matting of FIG. 4.
Figure 5:
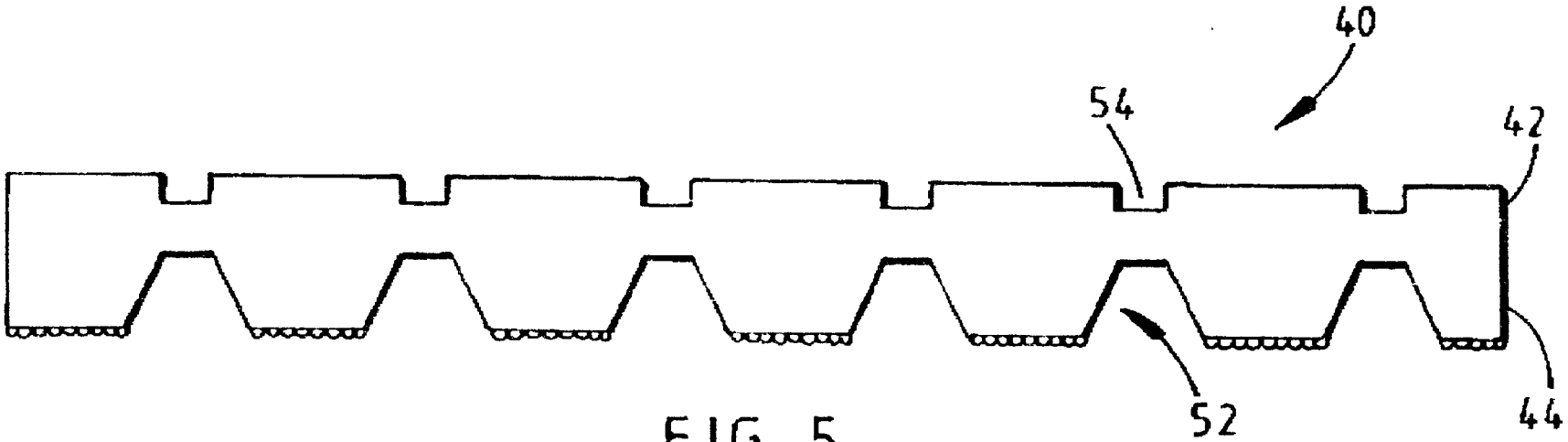
FIG. 5 is an end view of the matting of FIG. 4.

Reference is now made to FIGS. 4, 5 and 6 of the drawings, which illustrate matting 40 in accordance with a second embodiment of the present invention. The matting 40 shares many features with the matting 10 described above, comprising an upper layer 42 and a lower layer 44, the upper layer defining a plurality of spaced upstanding strips 46 having slots 48 therebetween. Strips of carpet 50 are located in the slots 48. The lower layer 44 defines a plurality of spaced slots 52 which intersect the slots 48 in the upper layer 42 to permit water to drain from the carpet 50 through the matting 40.

The upper surface of the strips 46 defines channels 54 which extend transversely 54*a* and in a criss-cross manner 54*b*, the channels meeting at the edges of the strips 46 directly above the openings 58 that are formed where the slots 48, 52 intersect. As may be seen from FIG. 6, the carpet backing 62 is slightly narrower than the slots 48 to provide space for water to pass between the carpet 50 and the walls of the slot 48 and through the openings 58.

It will be evident to those of skill in the art that the above-described embodiments provide many advantages over prior art entrance matting and permits use of matting having an appearance similar to that described and illustrated in WO-A-9307789 to be used in wet conditions, and even out of doors.

It will further be clear to those of skill in the art that various modifications and improvements may be made to the above-described embodiment without departing from the present invention, for example: the drain slots 22 may be rectangular rather than trapezoidal, and need not necessarily be perpendicular to the carpet receiving slots 18.

We claim:

1. Matting comprising an upper layer and a lower layer, the upper layer including a plurality of spaced upstanding strips having slots therebetween and an upper surface of each strip defining transversely extending channels in communication with the slots, and strips of carpet being located in the slots such that the strips collectively define a substantially continuous tread surface, the lower layer defining a plurality of spaced slots intersecting the slots in the upper layer to permit water to drain therethrough.

2. The matting of claim 1, wherein the upper surfaces of the upstanding strips are slightly convex, such that water will tend to flow from the surfaces of the strips towards the slots.

3. The matting of claim 1, wherein the channels in the upper surfaces of the upstanding strips intersect with slots in the upper layer adjacent intersections between the upper and lower slots.

4. The matting of claim 1 wherein the channels define a criss-cross pattern and each channel extends between the slots on either side of a strip and intersects at least one other channel.

5. The matting of claim 1, wherein chevron-spaced channels are provided on the upper surfaces of the upstanding strips.

6. The matting of claim 1 wherein the slots in the upper and lower layers are substantially perpendicular to one another.

7. The matting of claim 1 wherein the carpet strips comprise pile and a backing.

8. The matting of claim 7, wherein the backing is water impermeable and passage of water between the carpet backing and the walls of the upper slots is ensured by providing the carpet strips with a backing which is slightly narrower than the slots.

9. The matting of claim 1 wherein the upper layer and the lower layer are flexible.

* * * * *